United States Patent [19]

Smith

[11] Patent Number: 4,588,920

[45] Date of Patent: May 13, 1986

[54] DISPLAY TUBE AND AN ELECTRON BEAM DEFLECTOR THEREFOR

[75] Inventor: James Smith, Reigate, England

[73] Assignee: U.S. Philips Corporation, New York, N.Y.

[21] Appl. No.: 451,996

[22] Filed: Dec. 21, 1982

[30] Foreign Application Priority Data

Feb. 5, 1982 [GB] United Kingdom ..... 8203341

[51] Int. Cl.[4] ..... H01J 29/74

[52] U.S. Cl. ..... 313/422; 313/432; 313/460; 315/366; 315/370

[58] Field of Search ..... 313/422, 426, 421, 432, 313/439, 429, 458, 430; 315/366, 370

[56] References Cited

U.S. PATENT DOCUMENTS

| | | | |
|---|---|---|---|
| 3,209,252 | 9/1965 | Cumming | 313/432 X |
| 3,890,541 | 6/1975 | McCarthy | 313/422 X |
| 4,451,852 | 5/1984 | Masuda et al. | 313/422 X |
| 4,490,652 | 12/1984 | Beck | 313/422 X |

FOREIGN PATENT DOCUMENTS

| | | | |
|---|---|---|---|
| 853830 | 11/1960 | United Kingdom | 313/432 |

*Primary Examiner*—David K. Moore
*Assistant Examiner*—K. Wieder
*Attorney, Agent, or Firm*—Robert J. Kraus

[57] ABSTRACT

A display tube having an electron gun and an electron beam deflector including first and second electrode arrangements disposed successively along the electron beam path from the electron gun. Each electrode arrangement includes a pair of resistive plates extending transverse to the path of the electron beam and disposed on opposite sides of the path. The plates of each electrode arrangement are joined at their top and bottom ends and a potential difference is applied across the plates to provide electrical fields substantially normal to the electron beam path. The fields provided by the respective electrode arrangements are equal and opposite so that the angular deflection of the electron beam caused by the first electrode arrangement is cancelled by the second electrode arrangement and the electron beam leaves the electron beam deflector on a path parallel to (or coincident with) the path it entered the deflector. In order to ensure that no additional angular deflection of the electron beam occurs when it crosses the interface between the first and second electrode arrangements, the voltages applied to the second electrode arrangement are varied so that the point of entry of the electron beam is at an equipotential with that of the beam.

10 Claims, 7 Drawing Figures

DISPLAY TUBE AND AN ELECTRON BEAM DEFLECTOR THEREFOR

FIELD OF THE INVENTION

The present invention relates to a display tube, particularly but not exclusively to small (up to 150 mm diagonal), flat in-line display tubes, having an electron gun and an electron beam deflector for deflecting an electron beam generated by the electron gun in one plane.

DESCRIPTION OF THE PRIOR ART

In a known small flat display tube, described in British Patent Specification No. 1,592,571, the frame deflection of an electron beam is achieved by a pair of frame deflecting plates which diverge in the direction of electron travel. A disadvantage of using such frame deflecting plates is that the electron beam does not always follow parallel paths which means dynamic corrections are necessary in the beam deflection processes to overcome keystone distortions.

It is an object of the present invention to be able to deflect an electron beam so that keystone distortion is avoided or reduced substantially.

SUMMARY OF THE INVENTION

According to the present invention there is provided a display tube comprising, in combination:

(a) an envelope, and within the envelope (b) an electron gun for generating an electron beam, and (c) an electron beam deflector for deflecting the electron beam in one plane, wherein: the electron beam deflector comprises first and second electrode arrangements. The first electrode arrangement is controlled to apply an electron beam deflecting field transverse to the path of the electron beam and the second electrode arrangement is controlled to apply an opposite transverse field of the desired combination of strength and path length to cancel the deflection of the electron beam caused by the transverse electric field applied by the first arrangement. The second arrangement comprises a pair of spaced apart, planar resistive electrodes arranged parallel to each other and extending transverse to the path of the electron beam entering the first arrangement. Means is provided for coupling opposite ends of the resistive electrodes to a voltage source.

A display tube made in accordance with the present invention enables the output beam paths from the deflector to be parallel to (or coincident with) the path of the electron beam entering the deflector. The resultant absence of keystone distortion makes the subsequent beam deflection processes easier.

If desired the first electrode arrangement of the electron beam deflector may also comprise a pair of planar resistive electrodes across which a potential difference is applied, in which case in use the potentials applied to the opposite ends of the parallel arranged electrodes of the second arrangement are such that the transition of the electron beam from the first electrode arrangement to the second electrode arrangement is at an equipotential.

Display tubes having parallel plate beam deflectors have been disclosed for example in FIG. 8 of British Patent Specification No. 728,435 and in FIG. 3 of British Patent Specification No. 746,777. In both of these prior art arrangements an electron beam is deflected laterally by successively arranged pairs of conductive signal deflecting plates. The plates are cross-connected so that in operation when a voltage is applied to them an electron beam is deflected towards and away from the plates of each pair and in so doing the electron beam path is displaced laterally of the tube axis. This is different to the arrangement used in the display tube in accordance with the present invention wherein by using resistive electrodes along the length of which a potential difference is provided, the electron beam is always equidistant from the resistive electrodes of each pair but is deflected heightwise relative thereto by varying the actual voltages applied to the ends of the electrodes of each pair whilst keeping the potential difference thereacross constant. Consequently the resistive electrodes can be relatively closely spaced apart and thus exert a good deflection sensitivity.

In embodiments of the invention wherein the first and second deflector arrangements each comprise a pair of parallel resistive plates, the height, considered in a direction transverse to the path of the electron beam entering the first electrode arrangement, of the first electrode arrangement can be the same as, or smaller than, that of the second electrode arrangement. The potential difference applied across the plates of the first electrode arrangement being such that the field (E) is equal to, but is oppositely directed to, that produced by the second electrode arrangement. At the same time the actual voltages at the opposite ends of the resistive plates of the second electrode arrangement are varied to ensure that the electron beam does not undergo any additional deflection due to a potential mismatch when the electron beam crosses the interface between the first electrode arrangement and the second electrode arrangement.

In a particular embodiment where the first electrode arrangement is half the height of the second electrode arrangement, the second arrangement is divided electrically into upper and lower halves which means that each half can be considered separately and lower voltages used.

BRIEF DESCRIPTION OF THE DRAWING

The present invention will now be described, by way of example, with reference to the accompanying drawing, wherein:

FIG. 5(*b*) is a graph illustrating the potentials applied to the various electrodes shown in FIG. 5(*a*) in order to achieve a frame scan.

DESCRIPTION OF THE PREFERRED EMBODIMENTS

Figure 1:
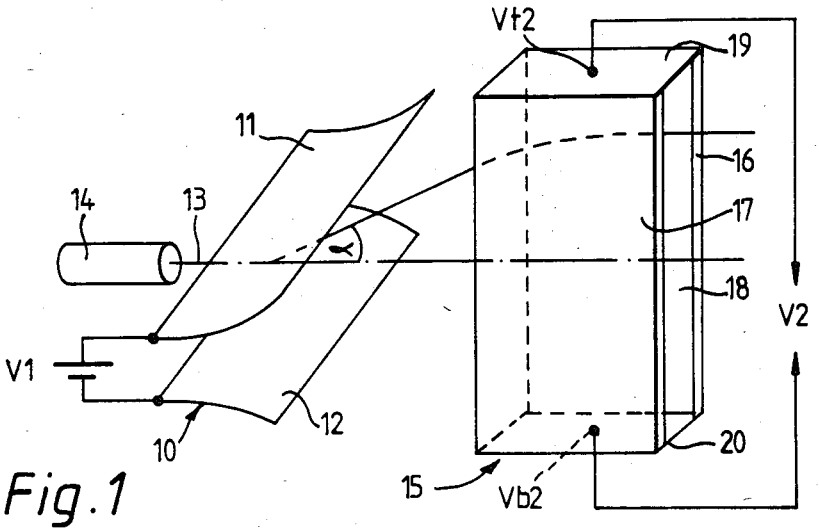
FIG. 1 illustrates a first embodiment of the electron beam deflector in which the first electrode arrangement comprises a pair of divergent plates.

The first embodiment of an electron beam deflector shown in FIG. 1 comprises a first electrode arrangement 10 in the form of a pair of divergent plates 11, 12 disposed above and below the path of the electron beam 13 from an electron gun 14. By applying a potential difference V1 across these electrodes 11, 12 the electron beam 13 is subject to a field (E) normal to the path of the electron beam which, when the voltage applied to the plates 11, 12, for example at frame frequency, is able to swing the beam through a variable angle denoted as $\alpha$ in FIG. 1. In order to counter the effect of the transverse field applied by the first electrode arrangement, a second electrode arrangement 15 is provided. This electrode arrangement 15 comprises a pair of planar plates 16, 17 disposed one on each side of the path of the electron beam to define a gap 18 of the order of 2 mm. The plates 16, 17 are of an insulating material such as ceramic or glass and a resistive film of the order of 10MΩ/square is applied to at least the facing surfaces of these plates. At their top and bottom edges, the plates are joined together by conducting plates 19, 20. A substantially constant potential difference V2 is maintained across the top and bottom plates 19, 20 so that the field (E) provided by the side plates 16, 17 counters that of the first electrode arrangement 10. In order to minimise problems at the interface between the exit of the first electrode arrangement 10 and the entry to the second electrode arrangement 15, it is necessary to choose the potential at the point of entry of the electron beam between the plates 16, 17 to reduce distorting fields in the gap between the first and second sets of plates. Simply applying the opposite potentials to those applied to the plates 11, 12 of the first arrangement 10 will not produce the desired matching. In consequence, it is necessary to vary the voltages Vt2 and Vb2 applied to the top and bottom conducting plates so that the potential difference V2 between them remains the same but optimisation of the equipotential lines at the interface of the first and second electrode arrangements is achieved. By doing this at field frequency, then the electron beam 13 is subjected to an opposite electric field (E) to that applied by the first electrode arrangement 10 thus causing the electron beam to be bent through an equal and opposite angle ($-\alpha$) applied by the first electrode arrangement 10 with the result that the electron beam leaves tne second electrode arrangement 15 along paths which are parallel to the path of the electron beam entering the first electrode arrangement 10. Conveniently, in the case of displaying television pictures, these paths correspond to the lines of a raster.

The theoretical operation of the embodiment of FIG. 1 will now be described with reference to FIG. 2. In the drawing, the electron beam produced by the electron gun has an energy eVg where Vg is the voltage at the output of the electron gun, $\alpha$ represents the angle of deflection produced by the first electrode arrangement 10, a corresponds to the distance between the deflection point in the first electrode arrangement 10 and the input side to the second electrode arrangement 15, d represents the length of the second electrode arrangement in the direction of electron movement, V2 corresponds to the potential difference between the top and bottom conducting plates and equals (Vt2−V2), $h_o$ is half the height of the side plates 16, 17 of the second electrode arrangement 15 and $h_m$ corresponds to the maximum half height deflection of the electron beam. By way of explanation, it will be assumed to a first approximation that the electron beam enters the second electrode arrangement 15 at an angle $\alpha$ as a result of the addition of a vertical component to the electron beam velocity by a vertical field produced in the first electrode arrangement 10 and that the space or interface between the two sets of electrode arrangements is field-free. The electron beam 13 then enters the vertical field region of the second electrode arrangement 15 with a vertical velocity $(2eVg/m)^{\frac{1}{2}} \tan \alpha$. For the electron beam to emerge from the second electrode arrangement 15 horizontally then V2 which equals (Vb2−Vt2) must equal $(4h_oVg \tan\alpha)/d$ and the beam will emerge at a height h above the axis where:

$$h=(a+d/2)\tan \alpha$$

By way of example, for values of $h_m=22.5$ mm, $h_o=25$ mm, a=15 mm, d=25 mm and Vg=250 Volts, then (Vb2−Vt2)=820 Volts and $\alpha$=b 39.3°. It has been found that no matter what values of Vb2−Vt2) are used there will always be a value of (Vb2−Vt2) that causes the beam to emerge horizontally for any deflection obtained in the first electrode arrangement. In consequence, a frame scan can be obtained provided that the required waveforms are generated and applied to the first and second electrode arrangements 10, 15.

Figure 3:
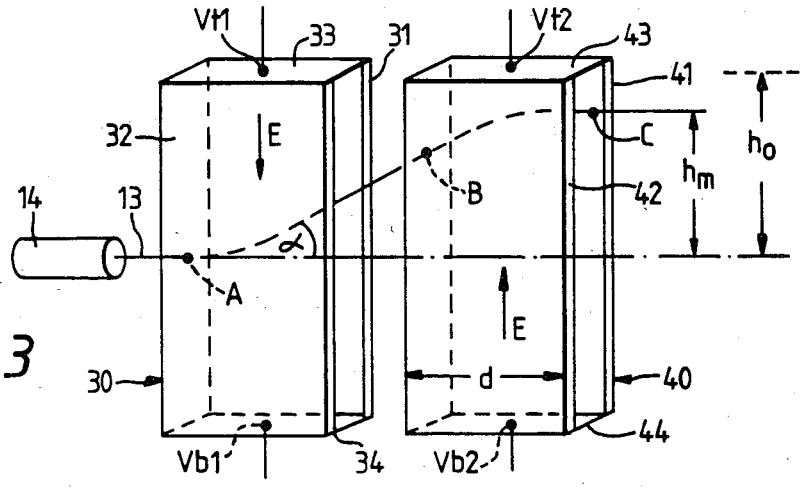
FIG. 3 illustrates a second embodiment in which the first and second electrode arrangements comprise pairs of plates having resistive coatings applied thereto.

In the embodiment shown in FIG. 3, two identical electrode arrangements 30, 40 are provided and separated from each other by a small space. Each of these deflector arrangements 30, 40 comprises side plates 31, 32 and 41, 42 of an insulating material such as ceramic or glass on which thick film resistive films of the order of 10 MΩ/square are provided. The side plates 31, 32 and 41, 42 are joined at their top and bottom by conductive plates 33, 34 and 43, 44, respectively, to define, for example, a 2 mm gap between the facing surfaces of the side plates, the electron beam 13 passing through this gap. The potentials applied to the top conductive plates 33, 43 of the first and second electrode arrangements 30, 40 are referenced Vt1 and Vt2, respectively, and those applied to the bottom electrodes are referenced Vb1 and Vb2, respectively. The potential difference between Vt1 and Vb1 corresponds to the potential difference between Vb2 and Vt2. However, the applied voltages are such that the field E of the second electrode arrangement is opposite that of the first one. In the drawings, the electron beam 13 enters the first electrode arrangement 30 at A and crosses to the second electrode arrangement 40 at B and leaves the second electrode arrangement at C along a path parallel to or coincident with the path of the input beam. As the beam is only subjected to equal and opposite fields at right angles to it, which fields cancel each other, then the forward component remains unchanged throughout the deflection process, the horizontal velocity being constant at $(2eVg/m)^{\frac{1}{2}}$. It is beneficial if, at the point B in the deflection path of the electron beam, the potential on entering the second electrode arrangement 40 is equal to that leaving the first electrode arrangement 30 to avoid unpredictable behaviour at the interface which may lead to additional angular deflection.

The time that the electron beam spends in each electrode space is defined by $(m/2eVg)^{\frac{1}{2}}d$ (d being the length of each electrode arrangement.)

The vertical displacement in each electrode arrangement is defined by $(eE/2m)\cdot(m/2eVg)\cdot d^2$ which equals $Ed^2/4Vg$.

Figure 2:
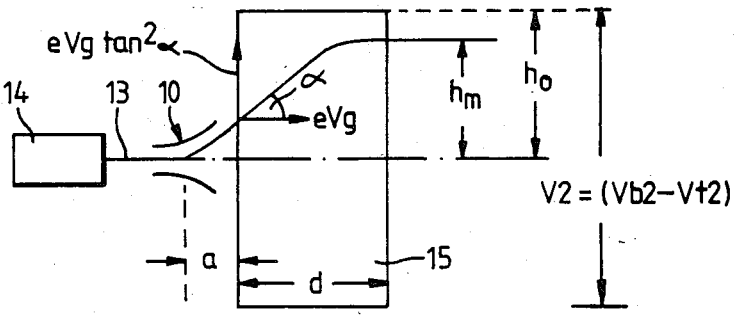
FIG. 2 is a diagram for explaining the operation of the embodiment shown in FIG. 1.

Using the same notation as in FIG. 2, for a maximum total displacement $h_m$ of 22.5 mm where d=25 mm, Vg=250 Volts, $h_0$=25 mm, and neglecting the finite gap between the two sets of plates then $11.25=E.25^2/4.250$ therefore E=18 Volts/mm and (Vt0−Vb1)=(Vb2−Vt2)=900 Volts. In which case with the point A being at 250 Volts the beam would emerge from the first set of plates at an equipotential of 453 Volts at B. Maintaining E at 18 Volts/mm in the second set plates, their voltages are made such that the equipotential at the point where the beam enters at B is also 453 Volts. For this matching of the equipotentials at B, the two sets of voltages are:

| | |
|---|---|
| Vt1 = 700 V | Vb1 = −200 V |
| Vt2 = 205 V | Vb2 = 1105 V |

and the beam finally emerges at an equipotential of 250 V at C.

In order to be able to carry out frame deflec of the electron beam then it is necessary to apply the appropriate voltages to the top and bottom plates of the electrode arrangements 30, 40. A set of typical voltages is shown in FIG. 4.

Figure 4:
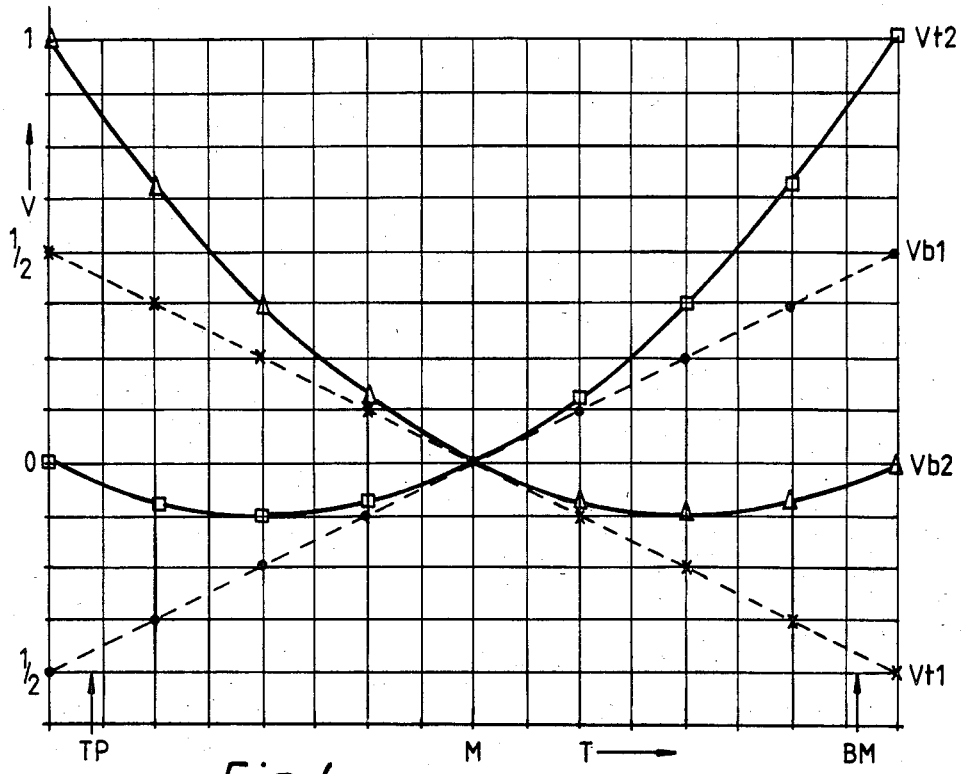
FIG. 4 is a graph illustrating the voltages applied to the electrode arrangements shown in FIG. 3 in order to achieve a frame scan.

In FIG. 4 the abscissa represents units of time T, and the ordinate represents the deflector voltages relative to each other; the top TP of the frame is at the left hand end of the abscissa, the bottom BM of the frame is at the right hand end of the abscissa and M represents the middle. From an examination of FIG. 4, it will be noted that Vt1 and Vb1 are varied linearly in such a manner that the two voltages intersect at zero for deflection at the middle of the screen, is one would expect, because the electron beam follows a path straight through both electrode arrangements without any deflection. However, in the case of Vt2 and Vb2 the voltages are varied along non-linear paths in order to obtain the desired equipotential at B in FIG. 3. Like Vt1 and Vb1, these two voltages also intersect at zero which corresponds to the middle of the screen. It can be shown from a study of the various curves in FIG. 4 that although the actual voltages Vt2 and Vb2 vary non-linearly, the fields across both the electrode arrangements 30, 40 remain equal and opposite.

If desired in FIG. 3, the height of the first electrode arrangement 30 can be less than that of the second electrode arrangement 40 because the extent of the swing of the electron beam is only half that of the overall swing which it is necessary to achieve. A consequence of making the height of the first electrode arrangement 30 smaller than that of the second electrode arrangement 40 is that in order to maintain the same field as in the higher second electrode arrangement Vt1 and Vb1 would be smaller than shown in FIG. 4.

Figure 5A:
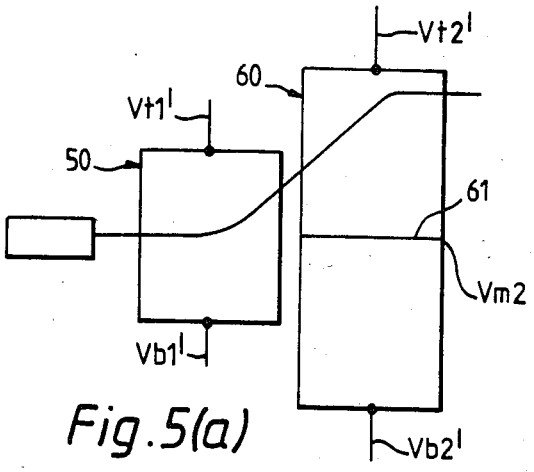
FIG. 5(*a*) is a sketch illustrating an electron beam deflector in the first electrode arrangement which is half the height of the second electrode arrangement which has been divided electrically into two halves.
Figure 5B:
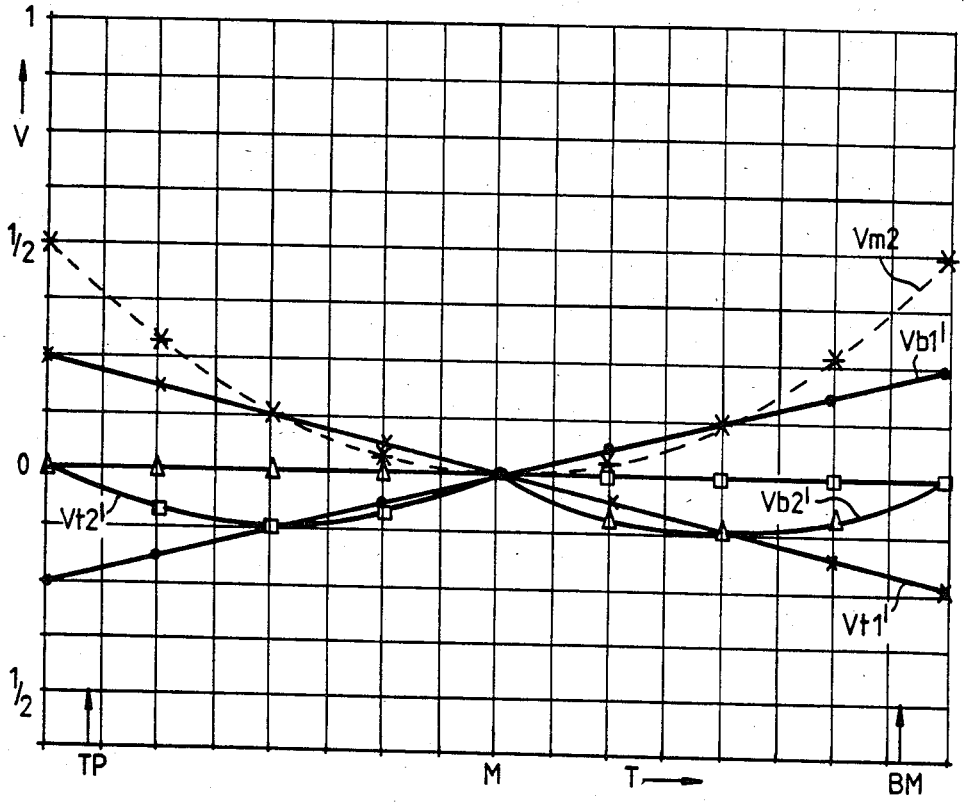

This idea is used in FIG. 5(*a*) in which the first electrode arrangement 50 is approximately half the height of that shown in FIG. 3 and the second electrode arrangement 60 electrically comprises two halves. The two halves are formed by interrupting the thick film resistive layers applied to the side plates by stripes 61 of a readily conductive material, such as gold, disposed parallel to the axis of the electron gun 14. The voltages applied to the top and bottom plates of the first and second electrode arrangements 50, 60 and to the stripes 61 are designated Vt1′, Vb1′, Vt2′, Vb2′ and Vm2. The relative voltages necessary to obtain the desired frame scan are shown in FIG. 5(*b*) the references on which correspond to those used in FIG. 4. An examination of FIG. 5(*b*) shows once again that Vt1′ and Vb1′ vary linearly and the maximum voltage swings relative to zero are half that compared with FIG. 4. In the case of the second electrode arrangement, Vm2 varies between a positive voltage and zero whereas Vt2′, when the electron beam is in the top half of the second electrode arrangement, varies from zero to a negative voltage and back to zero when the electron beam is following a middle path and thereafter Vt2′ is held at zero. As is evident from the drawing, Vb2′ varies in an opposite fashion to Vt2′ and it is possible that Vt2′ and Vb2′ can be derived from the same voltage source which is switched from Vt2′ to Vb2′ as the electron beam passes along a path coincident with its entry path.

In practice, when the beam length of the electron beam becomes longer, i.e. due to the greater extent that the electron beam is deflected, then dynamic focusing at the electron gun will become necessary.

When manufacturing the side plates with their resistive films thereon, in order to ensure a uniform field from the top to the bottom of the side plates the resistive films, which normally will comprise thick film inks, should be as homogeneous as possible. Whilst it is ideal for the side plates of each electrode arrangement to have identical resistive films, this is not essential as long as each film is homogeneous because the effect will be that the side plate which has a lower resistivity film will draw a higher current than the other one. However, since there is a continuous current flowing in the resistive films, when in use, it is desirable that this current be kept to the minimum. To avoid the film potential being affected by stray electrons the maximum current drain should be somewhat larger than the beam current.

Figure 6:
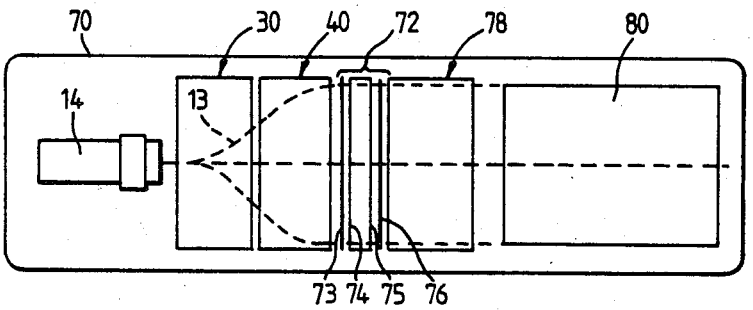
FIG. 6 is an illustrative view of a flat display tube incorporating the electron beam deflector shown in FIG. 3.

FIG. 6 illustrates an in-line monochrome flat display tube. The envelope 70 of the display tube can comprise a dished portion in which the electrodes are located and a sheet of plain glass on which the display screen is formed, which sheet seals the dished portion in a fluid-tight fashion. The electron beam 13 is produced by a gun 14 and after collimation undergoes frame deflection using the first and second electrode arrangements 30, 40 described with reference to FIG. 3. As the beam leaves the second electrode arrangement 40 with the same energy, say 250 electron volts, as it left the electron gun 14 it is necessary to accelerate the electron beam whilst ensuring that the beam spot on the screen is not unacceptably large. In FIG. 6, the energy of the electron beam is increased by means of an intermediate double electron lens 72 which comprises a first electron lens formed by first and second slotted electrodes 73, 74 and a second electron lens formed by third and fourth electrodes 75, 76. As the second electrode 74 of the first lens and the first electrode 75 of the second lens are at the same potential, it is convenient and more compact to combine them into a box-like structure having slots in the opposite upstanding walls. The first electron lens causes the electron beam to converge so that its image forms the object of the second electron lens which also converges the beam.

The electron beam on leaving the second electron lens undergoes line deflection by a line deflector formed by two spaced-apart divergent plates 78. By varying the potential difference between these two plates the angle of entry of the electron beam into the display region of the tube is varied. This display region comprises a screen 80 and a spaced-apart, parallel-arranged repeller electrode (not shown) which defines between them a trajectory-controll space. The repeller electrode is a large area electrode disposed behind the screen 80 and is therefore not visible. A substantially constant potential difference is maintained between the screen and the repeller electrode and consequently by varying the angle of entry of the electron beam into the trajectory-controlled space at line frequency, line scanning of the screen will be produced. Because the electron beam is deflected by the first and second electrode arrangements 30, 40 over the full height of the display screen and the electron beam paths are substantially parallel to each other and to the edge of the screen, the problem of keystone distortion is reduced to a minimum if not eliminated altogether.

In designing and operating the display tube illustrated in FIG. 6, it is preferred to keep the electron beam energy from the gun low so that the voltage swings (Vt1−Vb1) and (Vb2−Vt2), which are of the order of 5 times the electron gun voltage, do not become too large. It is then necessary however to provide the intermediate double electron lens 72 or an equivalent system to increase the beam energy after it has emerged from the deflecting system.

I claim:

1. A display tube including an envelope containing an electron gun for producing an electron beam and horizontal and vertical deflection means for deflecting the beam in horizontal and vertical planes extending along a path followed by the beam, at least one of said deflection means comprising, in succession along said path;

(a) a first electrode arrangement including a first pair of plates disposed on opposite sides of the path and including means for electrical connection to a first source of a potential difference, said plates being oriented to produce an electric field in a direction transverse to said path to effect deflection of the beam in the respective plane by an angle $\alpha$; and (b) a second electrode arrangement including a second pair of plates, comprising resistive electrodes, disposed on opposite sides of the path and including means for electrical connection of opposite ends of each of said resistive electrodes to a second source of a potential difference having a polarity opposite to that of the first source, said second pair of plates being oriented to produce an electric field in a direction opposite to that produced by the first pair of plates and having a predetermined strength and extending along a predetermined length of said path to counterdeflect the electron beam in the respective plane by an angle $-\alpha$ onto a path parallel to that along which it entered the first electrode arrangement.

2. A display tube as in claim 1 where the first pair of plates also comprises resistive electrodes and includes means for electrical connection of opposite ends of each of said resistive electrodes to the first source, the absolute value of the potentials applied to said first and second pairs of plates being established such that the potential where the electron beam emerges from the electric field between the first pair of plates is substantially equal to the potential where the electron beam enters the electric field between the second pair of plates.

3. A display tube as in claim 2 where the lengths of said first and second pairs of plates, measured transversely to the direction of the path followed by the electron beam as it enters the deflection means, are substantially equal.

4. A display tube as in claim 2 where the lengths of the first pair of plates, measured transversely to the direction of the path followed by the electron beam as it enters the deflection means, are approximately one-half of the lengths of the second pair of plates measured in the same direction.

5. A display tube as in claim 4 where the resistive electrodes in the second pair of plates are each separated into first and second sub-electrodes by a conductive stripe running across the respective electrode parallel to a path which would be followed by an undeflected electron beam.

6. A display tube including an envelope containing an electron gun for producing an electron beam directed along a predefined path, first deflection means for deflecting the beam in a first plane extending along said path, accelerating means for accelerating the electron beam exiting from the first deflection means, second deflection means for deflecting the accelerated beam in a second plane extending transversely with respect to the first plane, and the parallel combination of a repeller electrode and a luminescent screen defining therebetween a trajectory control space into which the second deflection means directs the electron beam, said first deflection means comprising, in succession along said path;

(a) a first electrode arrangement including a first pair of plates disposed on opposite side of the path and including means for electrical connection to a first source of a potential difference, said plates being oriented to produce an electric field in a direction transverse to said path to effect deflection of the beam in said first plane by an angle $\alpha$; and (b) a second electrode arrangement including a second pair of plates, comprising resistive electrodes, disposed on opposite sides of the path and including means for electrical connection of opposite ends of each of said resistive electrodes to a second source of a potential difference having a polarity opposite to that of the first source, said second pair of plates being oriented to produce an electric field in a direction opposite to that produce by the first pair of plates and having a predetermined strength and extending along a predetermined length of said path to counterdeflect the electron beam in said first plane by an angle $-\alpha$ onto a path parallel to that along which it entered the first electrode arrangement.

7. A display tube as in claim 6 where the first pair of plates also comprises resistive electrodes and includes means for electrical connection of opposite ends of each of said resistive electrodes to the first source, the absolute value of the potentials applied to said first and second pairs of plates being established such that the potential where the electron beam emerges from the electric field between the first pair of plates is substantially equal to the potential where the electron beam enters the electric field between the second pair of plates.

8. A display tube as in claim 7 where the lengths of said first and second pairs of plates, measured transversely to the direction of the path followed by the electron beam as it enters the deflection means, are substantially equal.

9. A display tube as in claim 7 where the lengths of the first pair of plates, measured transversely to the direction of the path followed by the electron beam as it enters the deflection means, are approximately one-half of the lengths of the second pair of plates measured in the same direction.

10. A display tube as in claim 9 where the resistive electrodes in the second pair of plates are each separated into first and second sub-electrodes by a conductive stripe running across the respective electrode parallel to a path which would be followed by an undeflected electron beam.

* * * * *